United States Patent [19]

Frenken et al.

[11] 3,973,310

[45] Aug. 10, 1976

[54] METHOD OF AND AN APPARATUS FOR FILLING MEMBRANE CASSETTES

[75] Inventors: Hans Frenken; Georg Schindler, both of Leverkusen; Horst Kramer, Steinenbrueck, all of Germany

[73] Assignee: AGFA-Gevaert, A.G., Leverkusen, Germany

[22] Filed: Sept. 3, 1974

[21] Appl. No.: 502,817

[30] Foreign Application Priority Data

Sept. 9, 1973 Germany ..... 2345258

[52] U.S. Cl. ..... 29/156.4 R; 29/405; 141/8; 141/67; 141/114; 156/145; 53/37

[51] Int. Cl.[2] ..... B23P 15/00; B23P 19/00

[58] Field of Search ..... 29/156.4 R, 404, 405, 29/200 R; 141/114, 67, 8; 156/145; 417/383, 389; 53/37

[56] References Cited

UNITED STATES PATENTS

| | | | |
|---|---|---|---|
| 2,219,578 | 10/1940 | Pittenger | 156/145 |
| 2,329,839 | 9/1943 | Kalowski | 156/145 |
| 2,378,920 | 6/1945 | Gillican | 141/114 |
| 2,902,936 | 9/1959 | Bradley | 417/383 |
| 3,036,526 | 5/1962 | Hise | 417/389 |
| 3,302,269 | 2/1967 | Cooper et al. | 29/404 |
| 3,619,310 | 11/1971 | Clarke | 156/145 |
| 3,750,721 | 8/1973 | Hudson | 141/114 |

FOREIGN PATENTS OR APPLICATIONS

| | | | |
|---|---|---|---|
| 432,835 | 3/1948 | Italy | 417/389 |
| 772,133 | 4/1957 | United Kingdom | 141/114 |

*Primary Examiner*—Lowell A. Larson
*Assistant Examiner*—Dan C. Crane
*Attorney, Agent, or Firm*—Connolly and Hutz

[57] ABSTRACT

For filling and adjusting double-membrane cassettes acting as link members in piston metering pumps, the sealing surfaces of the membranes are first coated with a resilient pressure-deformable cement. The membrane cassette is introduced still unclosed into a thermostat where an adjustable, uniform pressure is applied to the upper membrane. The membrane cassette is then filled under an excess pressure of from 0.2 to 1 atm. and closed. After closing, the membranes of the cassette are brought into plane-parallel alignment in an evacuation unit.

4 Claims, 6 Drawing Figures

METHOD OF AND AN APPARATUS FOR FILLING MEMBRANE CASSETTES

This invention relates to a method of and an apparatus for filling and adjusting a double-membrane cassette. Double-membrane cassettes are used in metering pumps: They act as a link between a metering compartment and an oil-filled piston chamber, and are used everywhere where stringent requirements are imposed with regard to the cleanness in the metering compartment. Piston metering pumps for example are unable to meet such stringent requirements on account of the difficulties involved in sealing pumps of this kind. So-called single-membrane metering pumps are not affected by these difficulties, however, if the membrane ruptures the product momentarily enters the pump compartment and mixes with the pump oil. Accordingly, double-membrane metering pumps are preferably used for dosing liquids which are extremely sensitive to impurities, for example photographic emulsions. The basic structure of a pump of this kind is shown in FIG. 1 of the accompanying drawings. A double-membrane cassette 1 separates a metering compartment 2 from a pump chamber 3. The cassette 1 comprises essentially a membrane support 4 and two steel membranes 5 and is filled with a liquid which does not have damaging effect upon the product accommodated in the metering compartment 2. In the metering of photographic emulsions, the membrane cassette is filled for example with distilled water. The pump chamber 3 is generally filled with oil or glycerin. The pressure amplitudes emanating from the stroke of the piston are transmitted through the double-membrane cassette 1 into the metering compartment 2. The metering compartment 2 has inlets and outlets built into return valves 6 and 7 for the product to be dosed.

The higher the dosing accuracy required, the greater the precision of the double-membrane cassette 1 has to be. In particular, it is necessary to watch for the following sources of error:

1. Air is trapped in the membrane cassette. The pump then dispenses quantities of product differing according to the counterpressure, because the trapped volume of air acts as a buffer volume.

2. The membrane cassette is internally free from air, but only inadequately filled with working liquid. In this case, the membranes bulge inwards to a certain extent. With each stroke of the pump, the membrane on the piston side enters its end position before the maximum piston stroke has been reached. As a result, the membrane is permanently overstressed so that its service life is shortened.

3. The membrane cassette is free from air and contains too much working liquid. In this case, both membranes are mechanically overstressed, which very quickly results in destruction of the membrane cassette.

4. Replacement of the membranes is frequently accompanied by a change in the metering rate due to differences in the initial deformation of the steel membranes which are formed of rolled plate. Initial deformation is determined by the conditions prevailing during the rolling process.

An object of the invention is to provide a process in which membrane cassettes can be filled reproducibly with the working liquid in the absence of air. In order to ensure the high dosing accuracy required, the steel membranes must assume an exactly plane parallel position relative to one another after filling.

According to the invention there is provided a method of filling and adjusting a double-membrane cassette capable of acting as a link between an oil-filled piston chamber and a metering compartment of a piston metering pump, comprising the steps of:

a. coating the sealing surfaces of the membranes opposite a membrane support with a resilient cement which deforms when the membranes are pressed on and evens out any irregularities, b. introducing the as yet unclosed membrane cassette into a thermostat where its lower membrane rests on a plane-parallel plate on the bottom of the container, whilst an adjustable uniform pressure is applied to the upper, opposite membrane by means of a second plane-parallel plate, c. filling the membrane cassette in the thermostat from a container with a working liquid under an excess pressure of from 0.2 to 1 atms, and closing the cassette after filling, d. removing the cassette connected to the said container from the thermostat and introducing it into an evacuation unit, in which plane-parallel plates with bores bear against the membrane surfaces from both sides and applying vacuum to the bores to draw the membranes against the plates and align them exactly plane-parallel.

An apparatus for carrying out this process comprises a filling unit for filling the cassette with the working liquid, and an evacuation unit for finally adjusting the cassette.

The filling unit preferably consists of a thermostat with a plane-parallel plate at its base serving as a supporting surface for the membrane cassette. A spindle with the counterplate is situated in the upper part of the thermostat. When the spindle is screwed down to a sufficient extent, the counterplate rests on the upper membrane surface. A desired contact pressure can be adjusted by means of the spindle. For filling, the membrane cassette is connected to a container filled with the working liquid. The pressure in this container is about 1 atm.

Final adjustment of the membrane cassette is carried out by means of an evacuation unit. This consists of two plane-parallel plates which are formed with bores and the interval between which is determined both by the thickness of the membranes and by the thickness of the cassette sections 8. The bores are connected to vacuum, so that the membranes are drawn on to the aforementioned plates when the evacuation unit is switched on.

Reproducibility and dosing accuracy are improved to a very considerable extent by filling and adjusting system described above. In addition, overstressing is avoided by the plane-parallel alignment of the membranes, being reflected in an increase in service life.

One embodiment of the invention is described by way of example in the following with reference to the accompanying drawings, wherein.

Figure 1:
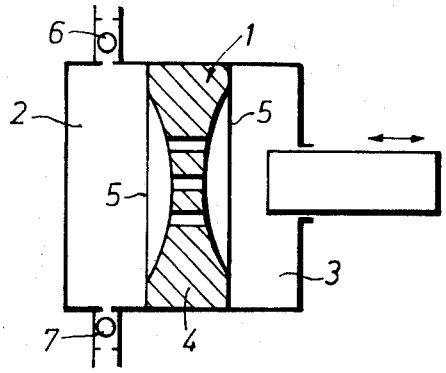
FIG. 1 illustrates the principle behind the double-membrane metering pump.

The principle behind the double-membrane metering pump according to FIG. 1 has already been explained above. The structure of the membrane cassette and the filling and adjusting operation are described below, beginning with the structure of the membrane cassette.

Figure 2B:
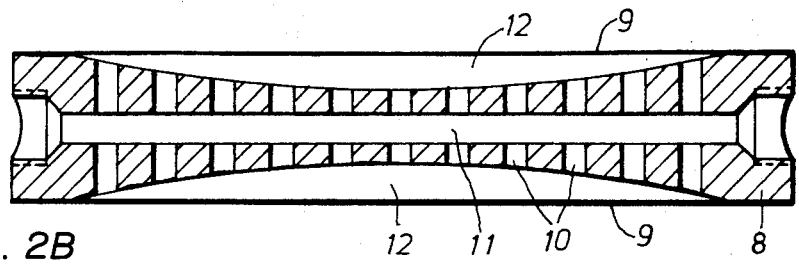
FIG. 2B is a cross-sectional view taken through 2A along the line 2B—2B.
Figure 2A:
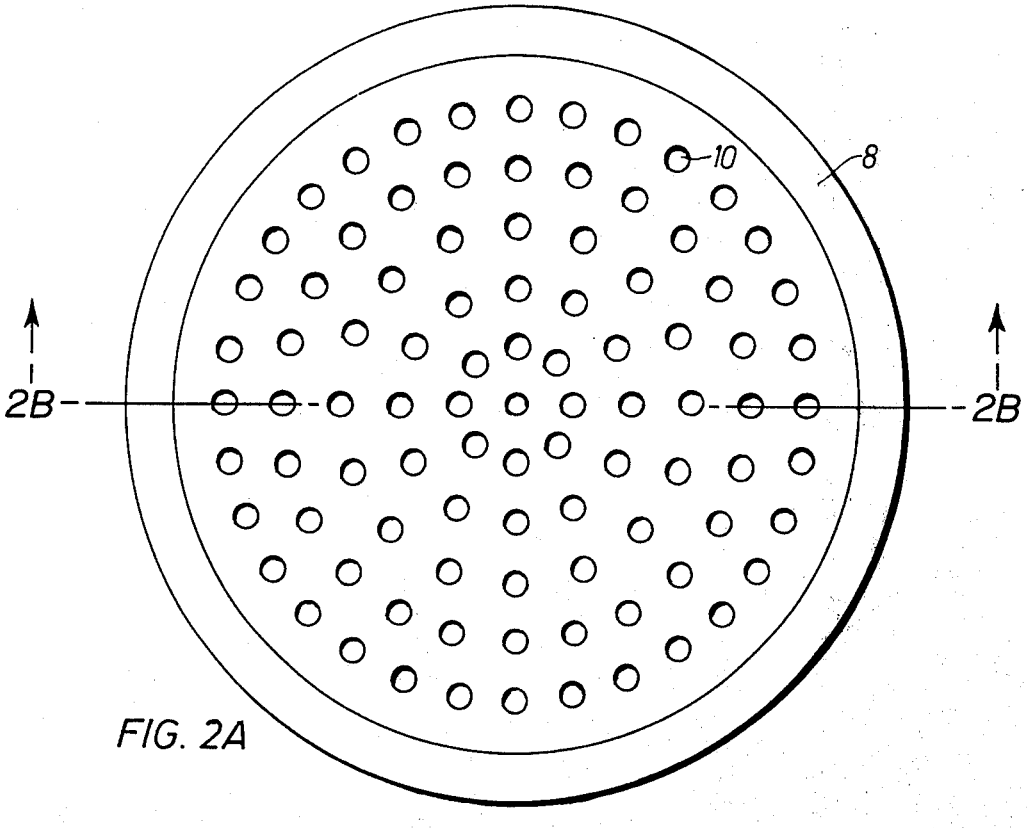
FIG. 2A is a top plan view of the membrane cassette.
Figure 3:
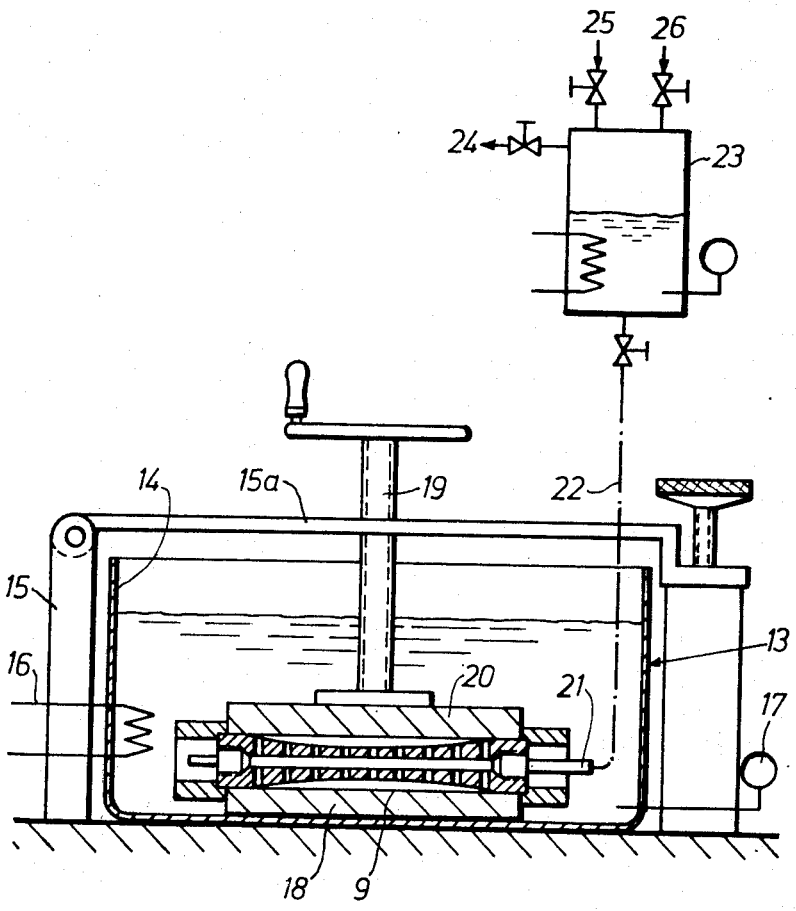
FIG. 3 shows the filling unit.

The membrane cassette shown in FIGS. 2A and 2B comprises a membrane support 8 and of the two steel membranes 9. The membrane support 8 is concave on both sides and formed with bores 10 perpendicularly of the membrane surfaces. The membranes 9 are only in contact with the edges of the membrane support 8. The supporting surface is formed by the sealing surface and is coated with a resilient cement. The filling liquid is introduced through a bore 11 into a membrane compartment 12 defined by the membranes and the membrane support. The membrane cassette is closed by means of two tension rings and holding screws (not shown).

To fill the membrane cassette with the filling liquid, for example distilled water, the membrane cassette is introduced into a liquid thermostat 13. The thermostat 13 is also filled with distilled water. Its temperature is regulated to be such that it corresponds to the subsequent working temperature of the double-membrane cassette in the pump. The thermostat 13 comprises a thermostat vessel 14 with a frame 15. Inside the thermostat vessel is a heating system 16 and a temperature detector 17. At the bottom of the vessel there is a circular plate 18 serving as a supporting surface for the membrane cassette 1. The diameter of this plate is equal to the diameter of the membrane.

In the upper part 15*a* of the thermostat frame 15 there is a screw or spindle 19 which at its lower end carries a plate 20. Its diameter is also equal to the diameter of the membrane. Any required pressure can be applied from outside the outer surfaces of the membranes by means of the spindle 19 and the supporting surface 18. An inlet 21 of the membrane cassette can be connected through a removable hose 22 to a vessel 23 holding the filling liquid. The filling liquid, in this case distilled water, is also thermostatically regulated. The vessel 23 is further provided with a vent line 24, a feed pipe 25 for distilled water and a compressed-air connection 26. The pressure of 0.2 to 1 atm. can be adjusted in the holding vessel 23 by means of the compressed air. The requisite filling pressure for the membrane cassette 1 is normally in that range. As already mentioned, the underside of the membrane cassette 1 is applied to the plane-parallel plate 18 during filling. The spindle 19 is then screwed down and the membranes pressed against one another under light pressure. The vessel 23 is then placed under excess pressure (0.2 – 1 atm.) with compressed air and the feedpipe 22 to the cassette 1 released. Under the effect of the internal excess pressure in the filling liquid, the membranes 9 (cf. FIG. 2B) are pressed uniformly against the plane-parallel plates 18 and 20. At the same time, a small quantity of filling liquid escapes laterally from the as yet unsealed cassette. At the same time, the membranes 9 are forced to assume a plane-parallel position. The cassette tension rings are then tightened by means of tightening screws, thus locking the membranes 9 in their enforced position.

Figure 4:
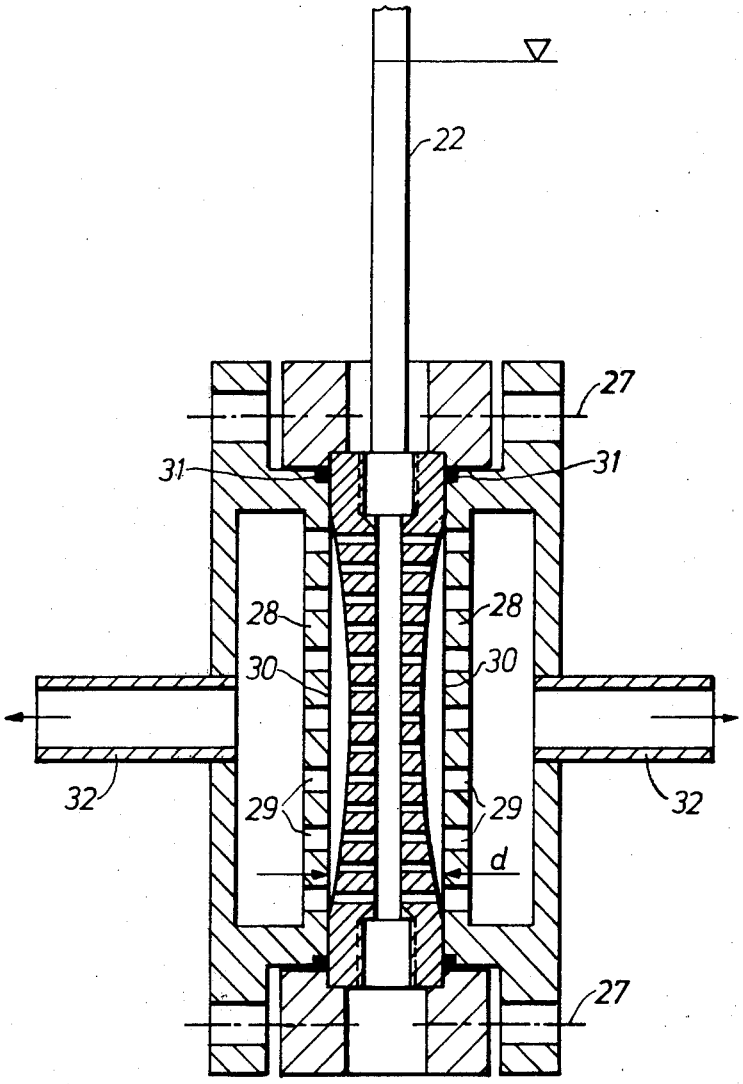
FIG. 4 shows the evacuation unit for finally adjusting the membrane cassette.
Figure 5:
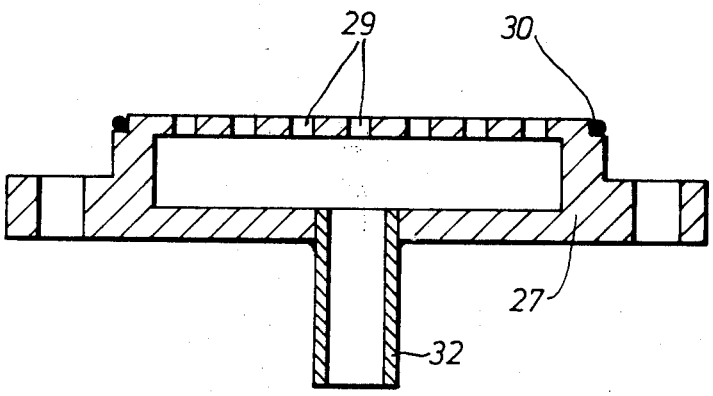
FIG. 5 shows the suction plate with bores belonging to the evacuation unit.
Figure 5:
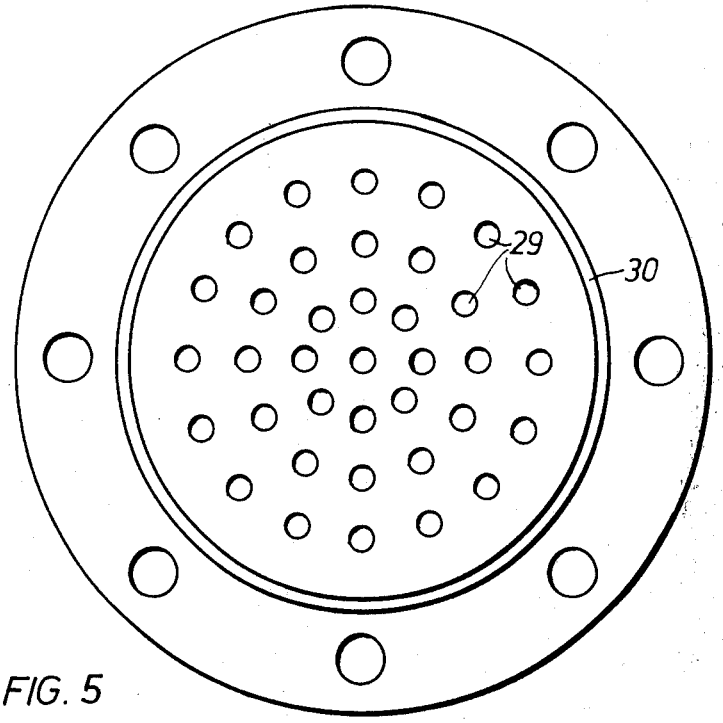

The membrane cassette 1 thus filled was formerly then removed from the thermostat after the feedpipe 22 was removed and the excess pressure in the vessel 23 switched off. It has been found that some slight deformation of the membrane can remain behind where it is filled in this way. The deformation involved is the bulging inwards of membranes to a certain extent. In order to eliminate this deformation and the error source which it involves in regard to dosing accuracy, the membrane cassette 1 is fastened by fastening screws 27 in an evacuation unit (FIG. 4) where the membranes 9 are finally adjusted and brought into plane-parallel alignment.

The evacuation unit comprises essentially two plane-parallel suction plates 28 with bores 29. The front surfaces 30 of the suction plates 28 bear tightly against the membranes 9. They are sealed off from the outside by means of an O-ring 31 on the suction plate 28. The interval between the two front surfaces 30 from one another is identical with the membrane interval *d* which is determined both by the thickness of the membranes 9 and by the thickness of the cassette sections 8.

After the membrane cassette 1 has been fastened securely in the evacuation unit, vacuum is applied to the bores 29 through the lines 32 to draw the membranes 9 onto the front surfaces 30 of the suction plates 28. At the same time, a small quantity of filling liquid (distilled water) flows out of the liquid vessel 23 into the membrane cassette 1. For this reason, the hose connection 22 should not be separated from the membrane cassette 1 when the membrane cassette is removed from thermostat 13 and introduced into the evacuation unit.

After full vacuum has been applied to the bores 29, the line 22 is removed and the membrane inlet 21 finally closed with a screw. The screws 27 of the evacuation unit are then released and the membrane cassette 1 removed. It is now completely full and finally adjusted and can subsequently be installed in this form in the metering pump.

We claim:

1. A method of filling and adjusting a double-membrane cassette capable of acting as a link between an oil-filled piston chamber and a metering compartment of a piston metering pump, comprising the steps of:

a. coating the sealing surfaces of the membranes opposite a membrane support with a resilient cement which deforms when the membranes are pressed on and evens out any irregularities, b. introducing as yet unclosed membrane cassette into a thermostat where its lower membrane rests on a plane-parallel plate on the bottom of the container, while an adjustable, uniform pressure is applied to the upper, opposite membrane by means of a second plane-parallel plate, c. filling the membrane cassette in the thermostat from a container with a working liquid under an excess pressure of from 0.2 to 1 atms, and closing the cassette after filling except for a small supplemental filling connection, d. removing the cassette connected to the said container from the thermostat, introducing it into an evacuation unit, in which plane-parallel plates with bores bear against the membrane surfaces from both sides and applying vacuum to the bores to draw the membranes against the plates and align them exactly plane-parallel whereby a small supplemental amount of working liquid flows through the small supplemental filling connection, removing the small supplemental filling connection and closing the cassette.

2. An apparatus for carrying out the method of filling and adjusting a double-membrane cassette capable of acting as a link between an oil-filled piston chamber and a metering compartment of a piston metering pump, comprising a filling unit for filling the membrane cassette with working liquid, the filling unit comprising a thermostat chamber into which the membrane cassette is introduced, a mechanical pressure assembly for holding the membrane cassette assembled together and a filling means connected to the membrane cassette for filling it with working liquid, an evacuation unit for finally adjusting the membrane cassette, the evacuation unit comprising a pair of opposed means for applying a vacuum to the membranes of the membrane cassette, clamping means connected to the pair of opposed vacuum applying means for holding them in firm sealing contact against the membrane cassette whereby the membranes are adjusted to a substantially flat condition, and the filling means connected to the membrane cassette permitting a small supplemental amount of working liquid to be added to the membrane cassette when the membranes are flattened by application of the vacuum.

3. An apparatus as claimed in claim 2, wherein a plane-parallel plate acting as a supporting surface for the membrane cassette is arranged on the bottom of the thermostat chamber, a spindle is arranged in the upper part of the thermostat chamber with a second plane-parallel plate which is in contact with the upper membrane surface and whose contact pressure is adjustable by means of the spindle, and means are provided for filling the membrane cassette after preliminary adjustment in the thermostat chamber by the two plane-parallel plates with the operating liquid under an excess pressure in the range from 0.2 to 1 atm.

4. An apparatus as claimed in claim 3, wherein the evacuation unit for finally adjusting the membrane cassette comprises two plane-parallel plates which are formed with bores and the interval between which is determined both by the thickness of the membranes and by the thickness of the cassette sections.

* * * * *